US012704039B2

(12) United States Patent
Feliu et al.

(10) Patent No.: US 12,704,039 B2
(45) Date of Patent: Aug. 11, 2026

(54) MEASURING DRILL PIPE ALIGNMENT IN ROTATING CONTROL DEVICE SYSTEM

(71) Applicant: SCHLUMBERGER TECHNOLOGY CORPORATION, Sugar Land, TX (US)

(72) Inventors: Rodrigo Feliu, Sugar Land, TX (US); Sara Escanero, Sugar Land, TX (US); Emilio De Matias Salces, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/102,863

(22) PCT Filed: Aug. 8, 2023

(86) PCT No.: PCT/US2023/071859

§ 371 (c)(1),
(2) Date: Feb. 11, 2025

(87) PCT Pub. No.: WO2024/036162

PCT Pub. Date: Feb. 15, 2024

(65) Prior Publication Data

US 2026/0055696 A1 Feb. 26, 2026

Related U.S. Application Data

(60) Provisional application No. 63/371,284, filed on Aug. 12, 2022.

(51) Int. Cl.
*E21B 33/08* (2006.01)

(52) U.S. Cl.
CPC ..... *E21B 33/085* (2013.01)

(58) Field of Classification Search
CPC ..... E21B 33/085; E21B 44/00
See application file for complete search history.

(56) References Cited

U.S. PATENT DOCUMENTS 4,531,580 A * 7/1985 Jones ..... E21B 33/085 277/343
4,783,084 A * 11/1988 Biffle ..... E21B 33/085 166/85.4
5,386,724 A * 2/1995 Das ..... E21B 47/007 73/152.59
5,448,924 A * 9/1995 Nagai ..... G01D 21/02 277/358

(Continued)

FOREIGN PATENT DOCUMENTS

WO 2021216311 A1 10/2021
WO WO-2025007212 A1 * 1/2025 ..... E21B 33/085
WO WO-2026018080 A1 * 1/2026 ..... E21B 33/085

*Primary Examiner* — Jennifer H Gay
(74) *Attorney, Agent, or Firm* — Jeffrey D. Frantz

(57) ABSTRACT

A system includes a drill pipe and a rotating control device including a housing defining a bore through which the drill pipe extends during a managed pressure drilling operation, a sealing element disposed in the housing that is configured to seal against the drill pipe to block fluid flow through an annular space surrounding the drill pipe, a bearing assembly disposed in the housing that enables the sealing element to rotate relative to the housing, and means for detecting eccentricity or misalignment of the drill pipe within the rotating control device during the managed pressure drilling operation.

9 Claims, 2 Drawing Sheets

(56) References Cited

U.S. PATENT DOCUMENTS

| | | | | |
|---|---|---|---|---|
| 6,354,385 | B1 | 3/2002 | Ford | |
| 9,074,443 | B2 * | 7/2015 | Gray | E21B 47/06 |
| 9,371,697 | B2 * | 6/2016 | Gray | E21B 47/12 |
| 9,822,628 | B2 * | 11/2017 | Pool | E21B 33/085 |
| 9,932,786 | B2 * | 4/2018 | Chambers | E21B 19/24 |
| 9,988,871 | B2 * | 6/2018 | Gray | E21B 47/13 |
| 10,081,985 | B2 * | 9/2018 | Bullock | E21B 47/024 |
| 10,119,347 | B2 * | 11/2018 | Johnson | E21B 33/06 |
| 10,161,225 | B2 * | 12/2018 | Jaffrey | G01L 1/242 |
| 10,273,793 | B2 * | 4/2019 | Johnson | E21B 47/007 |
| 10,280,743 | B2 * | 5/2019 | Khan | E21B 47/06 |
| 10,753,169 | B2 * | 8/2020 | Arefi | E21B 47/06 |
| 10,760,403 | B2 | 9/2020 | Ellis | |
| 10,781,657 | B2 * | 9/2020 | Hardt | E21B 44/00 |
| 10,801,296 | B1 * | 10/2020 | Pruitt | E21B 33/085 |
| 10,822,908 | B2 | 11/2020 | Coffey | |
| 12,019,426 | B2 * | 6/2024 | Aljubran | E21B 44/00 |
| 12,435,579 | B2 * | 10/2025 | Abuelaish | E21B 12/02 |
| 2005/0183865 | A1 * | 8/2005 | Williams | E21B 33/085 166/387 |
| 2009/0101411 | A1 | 4/2009 | Hannegan | |
| 2010/0008190 | A1 * | 1/2010 | Gray | E21B 33/064 367/83 |
| 2015/0285013 | A1 * | 10/2015 | Johnson | E21B 33/085 166/85.5 |
| 2015/0285054 | A1 * | 10/2015 | Johnson | E21B 47/007 73/152.48 |
| 2015/0308253 | A1 * | 10/2015 | Clark | E21B 33/02 175/24 |
| 2015/0315847 | A1 * | 11/2015 | Gray | E21B 33/064 702/9 |
| 2015/0337599 | A1 * | 11/2015 | Bullock | E21B 47/007 702/9 |
| 2015/0345236 | A1 * | 12/2015 | Chambers | E21B 33/085 166/381 |
| 2016/0273333 | A1 * | 9/2016 | Pool | E21B 47/00 |
| 2016/0348460 | A1 * | 12/2016 | Gray | G01V 11/002 |
| 2017/0009550 | A1 * | 1/2017 | Leuchtenberg | E21B 33/085 |
| 2017/0130562 | A1 * | 5/2017 | Jaffrey | E21B 47/001 |
| 2018/0245444 | A1 * | 8/2018 | Hardt | E21B 44/00 |
| 2018/0274323 | A1 * | 9/2018 | Arefi | E21B 47/08 |
| 2020/0115987 | A1 * | 4/2020 | Rome | A61K 31/352 |
| 2023/0367290 | A1 * | 11/2023 | Aljubran | E21B 44/04 |
| 2024/0352804 | A1 * | 10/2024 | Abuelaish | E21B 12/02 |
| 2026/0055696 | A1 * | 2/2026 | Feliu | E21B 33/085 |

* cited by examiner

MEASURING DRILL PIPE ALIGNMENT IN ROTATING CONTROL DEVICE SYSTEM

CROSS-REFERENCE TO RELATED APPLICATION

This application claims the benefit of U.S. Provisional Patent Application No. 63/371,284, filed Aug. 12, 2022, which is incorporated by reference herein in its entirety.

BACKGROUND

Drilling systems are often employed to access natural resources below the surface of the earth. Such drilling systems may include a drilling fluid system configured to circulate drilling fluid into and out of a wellbore to facilitate drilling the wellbore. In some cases, the drilling system may use managed pressure drilling ("MPD"), which may require the well to be "capped" with a rotating control device ("RCD"). An RCD is used to contain and isolate pressure in the wellbore annulus while rotary drilling. The RCD contains a sealing element and a bearing assembly. The sealing element creates a seal against the drill string while drilling. The bearing assembly allows the sealing element to rotate with the drill string, eliminating relative rotation between the drill string and the sealing element.

The drill string includes multiple drill pipes, connected together end-to-end. Each drill pipe generally has a tool joint at each end, where the diameter is increased from the main body of the drill pipe. The sealing element creates an elastomeric seal against the drill pipe outer diameter. The sealing element thus is configured to change and conform to the diameter of the drill pipe, including sealing both with the tool joint and the main body of the drill pipe, while the drill string is advancing.

Pipe misalignment is commonplace in the drilling environment. Often, perfectly aligning a rotary table or top-drive with the wellbore is difficult. On land, even when the rig is aligned, the rig can slowly misalign itself if there is ground movement. In offshore drilling, currents and wind can change, making positioning the rig in one spot without movement difficult. In conventional drilling, minor misalignment is not detrimental to operations because the drill string has enough compliance over its length to accommodate for this misalignment. However, when an RCD is being used, the RCD is normally placed very close to the rig floor (above the BOP on land, or at the top of the riser offshore). Because the RCD has a sealing element that seals against the drill string and a bearing that allows rotation, alignment becomes more critical. Any misalignment causes uneven wear on the sealing element, and sometimes even premature failure, as well as potential bearing damage. Whether the misalignment is a centerline to centerline offset, angular misalignment due to a tilt in the pipe, or a combination of both, huge forces on the order of 10 kips can be generated radially. FIG. 1, for example, shows a failed sealing element where misalignment is evident.

Currently, there is no way to detect drill string misalignment except by visual inspection, which can be subjective. For a visual inspection to result in a failure, the misalignment must be severe. Accordingly, there is a need for a more refined and quantitative measurement of drill string misalignment to avoid premature RCD sealing element failures.

SUMMARY

According to one or more embodiments of the present disclosure, a system includes: a drill pipe; and a rotating control device including: a housing defining a bore through which the drill pipe extends during a managed pressure drilling operation; a sealing element disposed in the housing that is configured to seal against the drill pipe to block fluid flow through an annular space surrounding the drill pipe; a bearing assembly disposed in the housing that enables the sealing element to rotate relative to the housing; and means for detecting eccentricity or misalignment of the drill pipe within the rotating control device during the managed pressure drilling operation.

A method according to one or more embodiments of the present disclosure includes extending a drill pipe through a bore defined in a housing of a rotating control device, the rotating control device further comprising: a sealing element disposed in the housing that is configured to seal against the drill pipe to block fluid flow through an annular space surrounding the drill pipe; and a bearing assembly disposed in the housing that enables the sealing element to rotate relative to the housing; actuating the sealing element of the rotating control device to seal about the drill pipe; rotating the drill pipe to initiate a managed pressure drilling operation; and detecting eccentricity or misalignment of the drill pipe within the rotating control device during the managed pressure drilling operation.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 2:
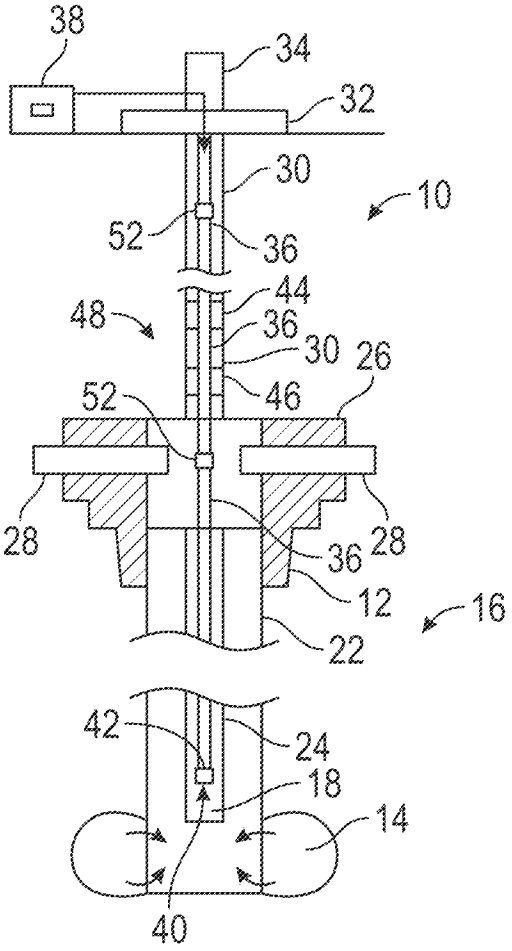
FIG. 2 is a schematic diagram of a drilling system that includes an RCD system according to one or more embodiments of the present disclosure.
Figure 1:
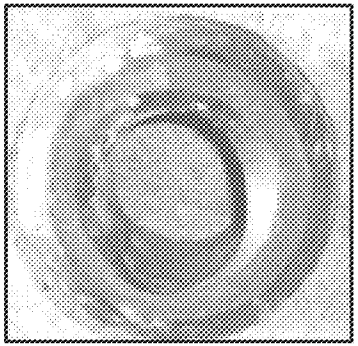
FIG. 1 shows a failed sealing element due to pipe misalignment.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," "up," "down," "upper," "lower," and variations of these terms is made for convenience, but does not require any particular orientation of the components relative to some fixed reference, such as the direction of gravity. The terms "connect," "connection," "connected," "in connection with," and "connecting," are used to mean "in direct connection with," or "in connection with via one or more elements." The terms "couple," "coupled," "coupled with," "coupled together," and "coupling" are used to mean "directly coupled together," or "coupled together via one or more elements." The term "fluid" encompasses liquids, gases, vapors, and combinations thereof. Any references to "metal" include metal alloys.

In general, embodiments of the present disclosure relate to MPD operations. More specifically, embodiments of the present disclosure relate to detecting drill pipe eccentricity or misalignment during MPD operations. For example, eccentricity or misalignment of the drill pipe can produce side forces and lateral deformation in the elastomeric sealing element of the RCD, resulting in accelerated fatigue and early failure. Such failures can be very costly in terms of time to make an unscheduled replacement of the elastomeric sealing element. Additionally, the failure may cause other components to be damaged, thereby adding time to the replacement as well as the cost of replacement components. Advantageously, detecting drill pipe eccentricity or misalignment during MPD operations and correcting that eccentricity or misalignment may greatly increase sealing element and bearing life of the RCD.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at a distal end portion of the drill string and may return toward a platform of the drilling system via an annular space between the drill string and a casing that lines the wellbore, i.e., the wellbore annulus.

As also set forth above, the drilling system may use MPD in some cases. MPD regulates a pressure and a flow of the drilling fluid within the drill string so that the flow of the drilling fluid does not over-pressurize a well (e.g., expand the well) and/or blocks the well from collapsing under its own weight. The ability to manage the pressure and the flow of the drilling fluid enables use of the drilling system to drill in various locations, such as locations with relatively softer seabeds.

The drilling system according to one or more embodiments of the present disclosure may include one or more RCDs. Each RCD is configured to form a seal across and/or to block fluid flow through the annular space that surrounds the drill string. For example, the RCD may be configured to block the drilling fluid, cuttings, and/or natural resources (e.g., carbon dioxide, hydrogen sulfide) from passing across the RCD from the well toward the platform. In some embodiments, the fluid flow may be diverted toward another suitable location (e.g., a collection tank) other than the platform.

Referring now to FIG. 2, a schematic diagram of a drilling system 10 that includes an RCD system 48 according to one or more embodiments of the present disclosure is shown. The drilling system 10 may be a subsea system, although the disclosed embodiments may be used in a land-based (e.g., surface) system. The drilling system 10 may use MPD techniques. As illustrated, the system 10 includes a wellhead assembly 12 coupled to a mineral deposit 14 via a well 16 having a wellbore 18.

Still referring to FIG. 2, the wellhead assembly 12 may include or be coupled to multiple components that control and regulate activities and conditions associated with the well 16. For example, the wellhead assembly 12 generally includes or is coupled to pipes, bodies, valves, and seals that enable drilling of the well 16, route produced minerals from the mineral deposit 14, provide for regulating pressure in the well 16, and provide for the injection of drilling fluids into the wellbore 18. A conductor 22 may provide structure for the wellbore 18 and may block collapse of the sides of the well 16 into the wellbore 18. A casing 24 may be disposed within the conductor 22. The casing 24 may provide structure for the wellbore 18 and may facilitate control of fluid and pressure during drilling of the well 16. The wellhead 12 may include a tubing spool, a casing spool, and a hanger (e.g., a tubing hanger or a casing hanger) to enable installation of the casing 24. As shown, the wellhead assembly 12 may include or be coupled to a blowout preventer (BOP) assembly 26, which may include one or more BOPs (e.g., one or more ram BOPs, one or more annular BOPs, or a combination thereof). For example, the BOP assembly 26 shown in FIG. 2 includes a ram BOP having moveable rams 28 configured to seal the wellbore 18.

Still referring to FIG. 2, a drilling riser 30 may extend between the BOP assembly 26 and a platform 32. The platform 32 may include various components that facilitate operation of the drilling system 10, such as pumps, tanks, and power equipment. The platform 32 may also include a derrick 34 that supports a tubular 36 (e.g., drill string, or drill pipe), which may extend through the drilling riser 30. A drilling fluid system 38 may direct the drilling fluid into the tubular 36, and the drilling fluid may exit through one or more openings at a distal end portion 40 of the tubular 36 and may return (along with cuttings and/or other substances from the well 16) toward the platform 32 via an annular space (e.g., between the tubular 36 and the casing 24 that lines the wellbore 18; between the tubular 36 and the drilling riser 30). A drill bit 42 may be positioned at the distal end portion 40 of the tubular 36. The tubular 36 may rotate within the drilling riser 30 to rotate the drill bit 42, thereby enabling the drill bit 42 to drill and form the well 16. The tubular 36 may be extended by coupling pipe segments to one another via joints 52, as shown in FIG. 2, for example.

Still referring to FIG. 2, the drilling system 10 may include multiple RCDs, such as a first RCD 44 and a second RCD 46, that are each configured to form a seal across and/or to block fluid flow through the annular space that surrounds the tubular 36. For example, the first RCD 44 and the second RCD 46 may each be configured to block the drilling fluid, cuttings, and/or other substances from the well 16 from passing across the first RCD 44 and the second RCD 46, respectively, from the well 16 toward the platform 32. The multiple RCDS may be part of an RCD system 48. It should be appreciated that the multiple RCDs may include any suitable number of RCDs (e.g., 2, 3, 4, or 5), and also that certain features (e.g., control features, features of a sealing element of the RCD, and/or features of an actuator system of the RCD) disclosed herein may be used in the context of a drilling system that includes only one RCD. Furthermore, the one or more RCDs may be positioned at any suitable location within the drilling system 10, such as any suitable location between the wellbore 18 and the platform 32. For example, as shown, the one or more RCDs may be positioned along the drilling riser 30 and between the BOP assembly 26 and the platform 32.

Figure 3:
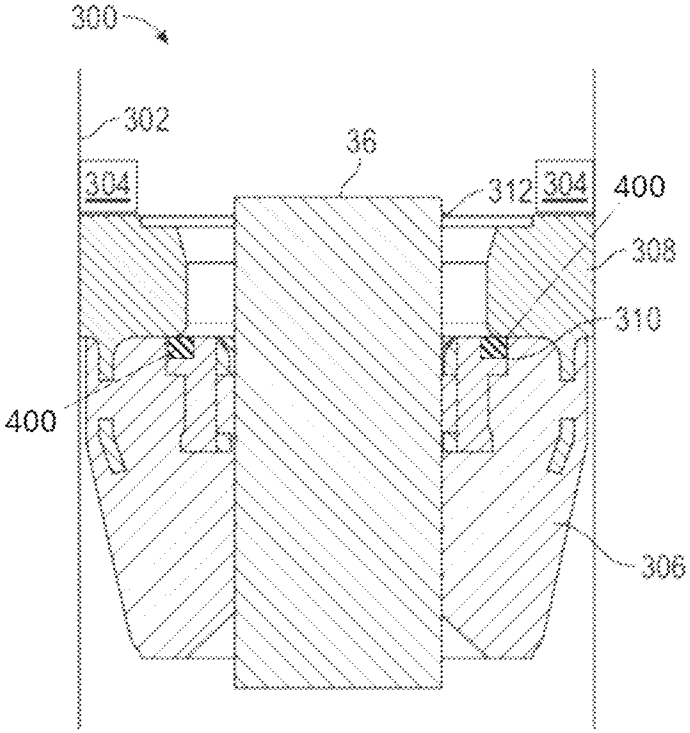
FIG. 3 shows a cross-sectional view of a rotating control device receiving a drill pipe therethrough, according to one or more embodiments of the present disclosure.

Referring now to FIG. 3, a cross-sectional view of an RCD 300, which may be included in the drilling system 10 as previously described in view of FIG. 2, is shown. According to one or more embodiments of the present disclosure, the RCD 300 includes a housing 302 defining a bore 312, a sealing element 306 disposed in the housing 302, and a bearing assembly 304 disposed in the housing 302. During an MPD operation, tubular 36 (e.g., drill string or drill pipe), as previously described with respect to FIG. 2, may extend through the bore 312 defined in the housing 302 of the RCD 300. According to one or more embodiments of the present disclosure, the sealing element 306 of the RCD 300 is configured to seal against the tubular 36 to block fluid flow through an annular space surrounding the tubular 36, as previously described. The sealing element 306 may seal around the tubular 36 upon actuation of one or more pistons incorporated into an assembly of the RCD 300, for example. According to one or more embodiments of the present disclosure, the bearing assembly 304 enables the sealing element 306 of the RCD 300 to rotate relative to the housing 302.

Still referring to FIG. 3, the RCD 300 according to one or more embodiments of the present disclosure may also include a ring 308 and an insert 310, which interface between the sealing element 306 and the bearing assembly 304. The ring 308 may be made of a relatively rigid (e.g., as compared to the sealing element 306) material, such as metal, and may be configured to be coupled to the bearing assembly 304, for example, to permit the RCD 300 to rotate along with the tubular 36 during an MPD operation. The ring 308 may be constructed as a single piece, and thus may have an inner diameter that is sufficiently large to permit the largest diameter of the tubular 36 for use therewith to pass through the ring 308. The tubular 36 may include a body and a joint (e.g., at one or both ends of the body), with the joint extending radially outward from the body. Accordingly, the inner diameter of the ring 308 is at least as large as the outer diameter of the joint of the tubular 36 and thus a gap may be defined radially between the tubular and the ring 308 as the body of the tubular 36 moves through the ring 308.

The sealing element 306 may be made at least partially of a relatively soft (e.g., compared to the ring 308), resilient material, such as an elastomer. The sealing element 306 may be configured to seal with the tubular 36 that passes therethrough, and may thus be configured to radially expand and contract by engagement with the tubular 36, e.g., as a joint moves through the sealing element 306 and then the body moves through the sealing element 306. The sealing element 306 may be molded to the ring 308. The sealing element 306 may generally have a tapered (conical) geometry, such that wellbore pressure from below presses the sealing element 306 against the tubular 36 received therethrough, forming a positive seal.

The insert 310 may also be at least partially embedded within the sealing element 306, and may be made of a relatively rigid (e.g., as compared to the sealing element 306) material, such as a metal. For example, the sealing element 306 may be molded onto or around the insert 310, otherwise bonded to the insert 310, which provides for attachment to the rest of the RCD assembly. According to one or more embodiments of the present disclosure, the insert 310 may have an inner diameter that is sized so as to permit the sealing element 306 to seal with, and permit passage of, both the joint and the body of the tubular 36, when the tubular 36 is being run through the RCD 300.

One or more embodiments of the present disclosure include several methods for measuring the eccentricity of the tubular 36 in the RCD 300 to reduce tubular 36 misalignment and increase the service life of components of the RCD 300, including the sealing element 306 and the bearing assembly 304. Accordingly, the RCD 300 according to one or more embodiments of the present disclosure may also include means for detecting eccentricity or misalignment of the tubular 36 within the RCD 300 during the MPD operation, as further described below.

According to one or more embodiments of the present disclosure, the means for detecting eccentricity or misalignment of the tubular 36 within the RCD 300 during the MPD operation includes a plurality of load cells placed on the housing 302 of the RCD 300 to interface with a stationary portion of the bearing assembly 304. If any side load is present, the plurality of load cells would show where the misalignment of the tubular 36 is, according to one or more embodiments of the present disclosure.

According to one or more embodiments of the present disclosure, the means for detecting eccentricity or misalignment of the tubular 36 within the RCD 300 during the MPD operation includes a plurality of inclinometers or a plurality of inertial measurement units (IMUs) placed inside the sealing element 306. As understood by persons having ordinary skill in the art, IMUs contain accelerometers and gyroscopes to measure different parameters, including tilt or orientation. The relative inclination between the plurality of inclinometers or the plurality of IMUs would indicate any angular misalignment as the sealing element 306 is being pushed more on one side than the other.

According to one or more embodiments of the present disclosure, the means for detecting eccentricity or misalignment of the tubular 36 within the RCD 300 during the MPD operation includes at least one strain gauge disposed in the sealing element 306. In one or more embodiments of the present disclosure, strain gauges in the sealing element 306 can detect when the tubular 36 is not applying symmetric force on the sealing element 306, thus enabling eccentricity and misalignment of the tubular 36 to be detected.

According to one or more embodiments of the present disclosure, the means for detecting eccentricity or misalignment of the tubular 36 within the RCD 300 during the MPD operation includes a plurality of caliper fingers incorporated into the sealing element 306. The plurality of caliper fingers measures elastomer expansion of the sealing element 306. As such, any misalignment of the tubular 36 passing through the sealing element 306 would be detected by the plurality of caliper fingers within the sealing element 306, according to one or more embodiments of the present disclosure.

According to one or more embodiments of the present disclosure, the means for detecting eccentricity or misalignment of the tubular 36 within the RCD 300 during the MPD operation includes an acoustic sensor and/or an array of acoustic sensors placed in the housing 302 of the RCD 300. In this way, the acoustic sensor provides a "sonar" map of the wellbore 18, which can facilitate calculation of the location of the tubular 36.

According to one or more embodiments of the present disclosure, the means for detecting eccentricity or misalignment of the tubular 36 within the RCD 300 during the MPD operation includes a plurality of proximity sensors mounted to the housing 302 of the RCD 300. In this configuration, the plurality of proximity sensors measures distance changes from the sealing element 306 to the wall of the housing 302 of the RCD. If there is eccentricity or misalignment of the tubular 36 within the RCD 300, the plurality of proximity sensors on one side of the housing 302 would show more deformation than a plurality of proximity sensors disposed on the other side of the housing 302.

According to one or more embodiments of the present disclosure, the means for detecting eccentricity or misalignment of the tubular 36 within the RCD 300 during the MPD operation includes at least one load cell integrated into the insert 310 that at least partially interfaces between the sealing element 306 and the bearing assembly 304. According to one or more embodiments of the present disclosure, the insert 310 may include a metal as previously described. According to one or more embodiments of the present disclosure, the load cell may be incorporated into a shear-beam load cell design, as understood by persons having ordinary skill in the art. For example, commercially available load cells such as those manufactured by Interface Force Measurement Solutions may be integrated into the insert 310 of the RCD 300 for detecting eccentricity or misalignment of the tubular 36 within the RCD 300, according to one or more embodiments of the present disclosure.

Figure 4:
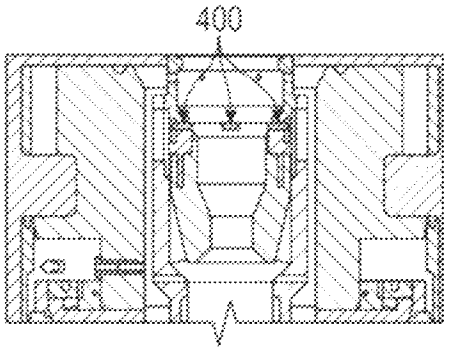
FIG. 4 shows placement of an array of load sensors in a rotating control device, according to one or more embodiments of the present disclosure.

According to one or more embodiments of the present disclosure, the means for detecting eccentricity or misalignment of the tubular 36 within the RCD 300 during the MPD operation includes a plurality of load sensors 400 placed in an interface between the sealing element 306 and the insert 310 of the RCD 300. An example configuration of the plurality of load sensors 400 placed in a sealing element interface and arranged in an array is shown in FIG. 4, according to one or more embodiments of the present disclosure. If the plurality of load sensors placed in the sealing element interface indicates that the load is imbalanced, then the tubular 36 is misaligned, according to one or more embodiments of the present disclosure.

According to one or more embodiments of the present disclosure, the means for detecting eccentricity or misalignment of the tubular 36 within the RCD 300 during the MPD operation may communicate with a controller, such as a programmable logic controller (PLC), for example. Specifically, the means for detecting eccentricity or misalignment of the tubular 36 is configured to output information relating to alignment of the tubular 36 to the controller, according to one or more embodiments of the present disclosure. For example, the information relating to the alignment of the tubular 36 may be a quantitative measurement detected by the means for detecting eccentricity or misalignment of the tubular 36 that is indicative of tubular 36 eccentricity or misalignment, according to one or more embodiments of the present disclosure. Based on the information relating to the alignment of the tubular 36 within the RCD 300 received by the controller, the controller may alert an operator of the drilling system 10 in real time so that action may be taken to correct or compensate for any misalignment of the tubular 36 during the MPD operation. Instead of implementing a controller, the means for detecting eccentricity or misalignment of the tubular 36 within the RCD 300 may output an analog reading of information relating to alignment of the tubular 36 during the MPD operation, according to one or more embodiments of the present disclosure. Moreover, alignment pieces, such as those described in U.S. Pat. Nos. 10,119,347 and 10,273,793, which are incorporated by reference herein in their entirety, may be used to ensure that the tubular 36 is aligned within the RCD 300 within a desired tolerance, thereby correcting the eccentricity or the misalignment of the tubular 36 within the RCD 300, according to one or more embodiments of the present disclosure.

A method according to one or more embodiments of the present disclosure also includes monitoring a condition of the RCD 300. The information relating to alignment of the tubular 36 within the RCD 300 that is detected by the means for detecting eccentricity or misalignment of the tubular 36 within the RCD 300, as previously described, may be used to detect physical characteristics (e.g., deformation, contact stress, etc.) of the sealing element 306 and/or the bearing assembly 304 of the RCD 300 to monitor a condition of these components, according to one or more embodiments of the present disclosure. Using a controller, such as the PLC as previously described, this data or information relating to the alignment of the tubular 36 within the RCD 300 may be recorded in real time for use after the completion of the managed pressure drilling operation. Exploiting this real time data or information in this way facilitates monitoring of components of the RCD 300, which allows a remaining life of the RCD 300 components to be predicted. As such, a replacement of one or more of the RCD 300 components may be scheduled prior to a catastrophic failure of the component that could lead to increased downtime of the MPD operation and added costs.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S. C. 112(f). However, for any claims containing elements designated in any other manner, it is intended that such elements are not to be interpreted under 35 U.S.C. 112(f).

What is claimed is:

1. A system, comprising:

a drill pipe; and a rotating control device comprising:

a housing defining a bore through which the drill pipe extends during a managed pressure drilling operation;

a sealing element disposed in the housing that is configured to seal against the drill pipe to block fluid flow through an annular space surrounding the drill pipe;

a bearing assembly disposed in the housing that enables the sealing element to rotate relative to the housing;

an insert that at least partially interfaces between the sealing element and the bearing assembly, wherein the insert is comparatively more rigid than the sealing element; and at least one load cell integrated into the insert and configured to detect eccentricity or misalignment of the drill pipe within the rotating control device during the managed pressure drilling operation.

2. The system of claim 1, wherein the at least one load cell is configured to output information relating to alignment of the drill pipe within the rotating control device during the managed pressure drilling operation.

3. A method comprising:

extending a drill pipe through a bore defined in a housing of a rotating control device, the rotating control device further comprising:

a sealing element disposed in the housing that is configured to seal against the drill pipe to block fluid flow through an annular space surrounding the drill pipe;

a bearing assembly disposed in the housing that enables the sealing element to rotate relative to the housing;

an insert that at least partially interfaces between the sealing element and the bearing assembly; and at least one load cell integrated into the insert;

actuating the sealing element of the rotating control device to seal about the drill pipe;

rotating the drill pipe to initiate a managed pressure drilling operation; and detecting, via the at least one load cell, eccentricity or misalignment of the drill pipe within the rotating control device during the managed pressure drilling operation.

4. The method of claim 3, wherein the insert is comparatively more rigid than the sealing element.

5. The method of claim 3, further comprising:

correcting the eccentricity or the misalignment of the drill pipe within the rotating control device.

6. The method of claim 3, further comprising:

recording data or information relating to alignment of the drill pipe within the rotating control device in real time.

7. The method of claim 6, further comprising:

monitoring a condition of the rotating control device based on the data or information.

8. A system, comprising:

a drill pipe; and a rotating control device comprising:

a housing defining a bore through which the drill pipe extends during a managed pressure drilling operation;

a sealing element disposed in the housing that is configured to seal against the drill pipe to block fluid flow through an annular space surrounding the drill pipe;

a bearing assembly disposed in the housing that enables the sealing element to rotate relative to the housing;

an insert that at least partially interfaces between the sealing element and the bearing assembly, wherein the insert is comparatively more rigid than the sealing element; and a plurality of load cells placed in an interface between the sealing element and the insert, wherein each load cell of the plurality of load cells is configured to detect eccentricity or misalignment of the drill pipe within the rotating control device during the managed pressure drilling operation.

9. The system of claim 8, wherein the plurality of load cells is configured to output information relating to alignment of the drill pipe within the rotating control device during the managed pressure drilling operation.

* * * * *